US011110572B2

(12) United States Patent
Liao

(10) Patent No.: US 11,110,572 B2
(45) Date of Patent: Sep. 7, 2021

(54) CONNECTING SHAFT STRUCTURE OF ELECTRIC SCREWDRIVER

(71) Applicant: Hsieh Yuan Liao, Taipei (TW)

(72) Inventor: Hsieh Yuan Liao, Taipei (TW)

( * ) Notice: Subject to any disclaimer, the term of this patent is extended or adjusted under 35 U.S.C. 154(b) by 369 days.

(21) Appl. No.: 16/392,638

(22) Filed: Apr. 24, 2019

(65) Prior Publication Data

US 2020/0338703 A1 Oct. 29, 2020

(51) Int. Cl.
*B25B 23/00* (2006.01)
*B25B 21/00* (2006.01)

(52) U.S. Cl.
CPC ..... *B25B 23/0035* (2013.01); *B25B 21/00* (2013.01)

(58) Field of Classification Search
CPC . B25B 23/0035; B25B 23/0042; B25B 21/00; B25B 21/002
See application file for complete search history.

(56) References Cited

U.S. PATENT DOCUMENTS 2,566,183 A * 8/1951 Forss ..... B25B 23/141 173/169
3,329,185 A * 7/1967 Hettich ..... B25B 21/00 81/58.1
3,613,751 A * 10/1971 Juhasz ..... B25B 23/141 81/474
3,808,904 A * 5/1974 Gotsch ..... B25D 16/00 74/343
3,834,252 A * 9/1974 Abell ..... B25B 23/141 81/475
3,874,460 A * 4/1975 Schmid ..... B25D 16/006 173/109
6,446,735 B1 * 9/2002 Chen ..... B25B 21/02 173/93
6,688,406 B1 * 2/2004 Wu ..... B25D 16/00 173/109
6,832,533 B1 * 12/2004 Huang ..... B25B 23/1427 81/467
6,929,074 B1 * 8/2005 Lai ..... B25B 21/00 173/178
7,222,559 B2 * 5/2007 Wang ..... B25B 15/00 81/467
7,331,738 B2 * 2/2008 Hofbrucker ..... B25B 21/007 279/145
7,494,437 B2 * 2/2009 Chen ..... B25B 21/02 173/216
7,874,378 B2 * 1/2011 Chen ..... B25D 11/104 173/29
8,157,021 B2 * 4/2012 Chen ..... B25D 11/106 173/29
8,662,196 B2 * 3/2014 Nakashima ..... B25D 17/24 173/48
9,550,284 B2 * 1/2017 Seith ..... B25B 21/026

* cited by examiner

*Primary Examiner* — David B. Thomas
(74) *Attorney, Agent, or Firm* — Alexander Chen, Esq.

(57) ABSTRACT

An electric screwdriver connecting shaft that includes: an upper connecting shaft, a two-stage shaft hole with two different shapes in a shaft; and a lower connecting shaft, a two-stage shaft surface with two different shapes in a shaft; with the shaft corresponding to the upper connecting shaft and the lower connecting shaft, the hole is designed to the shaft hole coordinated with the two-stage shaft surface to achieve a guiding effect when combined, and to achieve better concentricity when connecting. It can also provide a more stable connecting effect to reduce the lock error and achieve good screw lock quality, and further prolong the service life of the connecting shaft.

8 Claims, 4 Drawing Sheets

CONNECTING SHAFT STRUCTURE OF ELECTRIC SCREWDRIVER

BACKGROUND OF INVENTION

1. Field of the Invention

The present invention relates generally to an improvement for the locking function of the electric screwdriver, and more particularly to an improvement for the connecting shaft, so that it has a more better and stable combination effect, thereby improving the accuracy of the screw lock operation.

2. Description of Related Art

The known push-down type electric screwdriver is composed of a motor mechanism for power output, a gear mechanism for power transmission and speed change, a clutch mechanism for setting of required torque value, a chuck mechanism for connection and disconnection of the screwdriver head, and a trigger mechanism for button operation. The electric screwdriver can be combined with various screwdriver heads through the chuck mechanism to achieve the desired screw lock operation and effect.

Referring to FIG. 4, the connecting shaft (8) is used to control the pressing action, which is usually achieved by mutual coordination of an upper connecting shaft (81) and a lower connecting shaft (82); one end of the upper connecting shaft (81) is concave and provided with one-font joint (811), the opposite end of the lower connecting shaft (82) is formed with a concave-font joint (821); so in combination, the lower connecting shaft (82) pushes upward the upper connecting shaft (81) to form a connecting function, which facilitates the transmission of power from the motor mechanism to the connecting shaft (8), and further drives the screwdriver head to perform a screw lock operation.

After careful observation of the action of the connecting shaft, it was found that the online operation of the push-down type electric screwdriver is repeatedly and continuously used, so that the lower connecting shaft will hit upward the upper connecting shaft to reach the combination at each start, and then separated after the completion of the locking operation, the connection is repeatedly combined and separated, the joint (811,821) for combination and driving action will be worn, and also the connecting shaft will be shaken due to the space in combination and screwing, thus affecting the screw lock accuracy of the motor driver. Obviously, it is impossible to achieve the correctness and accuracy required for industrial upgrading and precision screw lock operation.

Therefore, the inventor of this invention considers that in addition to being able to continuously exist in the market, the more excellent tool product should be continuously developed, especially for the precision of the screw lock, the more attention should be paid, so this invention is designed to be more practical.

SUMMARY OF THE INVENTION

This invention mainly aims to provide an improved structure for the electric screwdriver connecting shaft. By forming a shaft corresponding to the upper connecting shaft and the lower connecting shaft, the hole is designed as a special two-stage shaft hole and a two-stage shaft surface of mutual coordination with a guiding effect in combination, and can achieve better concentric effect when connected, and can also provide a more stable connecting effect, thereby reducing the locking error and achieving a good screw lock quality, and further prolonging the service life of the connecting shaft.

In order to achieve the above object, the technical means adopted in this invention is to design an electric screwdriver connecting shaft with improved structure, the connecting shaft includes: an upper connecting shaft, a disc is provided at the center of the overall non-length, the centers of two opposite sides of the disc are respectively provided with two shafts, wherein inside of one shaft is a two-stage shaft hole with two different shapes; and a lower connecting shaft, and a circular convex ring is provided at the center of the overall length, and the centers of two opposite sides of the circular convex ring are respectively provided with two shafts, wherein outside of one shaft is a two-stage shaft surface with two different shapes, and the two-stage shaft surface can be inserted into the two-stage shaft hole to achieve stable connection.

Said two-stage shaft hole of the upper connecting shaft is formed by a polygonal shaft hole extending from the end edge of the shaft to the inside and an extending circular shaft hole.

Said two-stage shaft surface of the lower connecting shaft is formed by a cylindrical shaft surface extending from the end edge of the shaft toward the circular convex ring and an extending polygonal shaft surface.

Said upper connecting shaft and the lower connecting shaft are sleeved with a spring.

The disc surface of said upper connecting shaft is distributed with two round holes to provide the embedded steel balls, which is connected with the clutch group to each other.

One side of the circular convex ring of said lower connecting shaft has a shaft hole away from the shaft of the two-stage shaft hole, and a corresponding hole is provided around the hole, and an embedded steel ball is provided therein, thereby facilitating the combination of the screwdriver head.

DETAILED DESCRIPTION OF THE INVENTION

Figure 1:
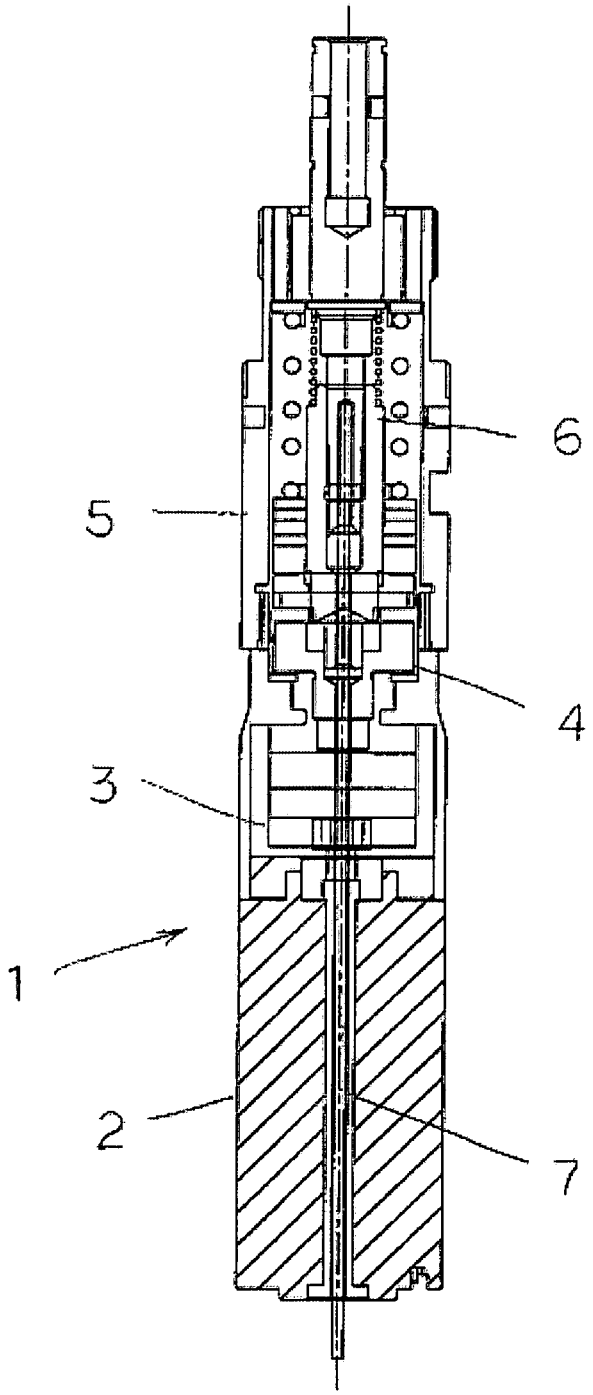
FIG. 1 is a structural diagram for electric screwdriver of the electric screwdriver connecting shaft of the present invention.

Referring to FIG. 1, which is an overall structure diagram of a push-down type electric screwdriver. The specific structure of the electric screwdriver (1) includes at least: motor (2), gear set (3), clutch set (4), torque tube group (5), connecting shaft (6) and thimble (7); wherein, the motor (2) provides the main power source; the gear set (3) provides the power connection and transmission. The clutch set (4) provides a tripping action when the lock reaches the torque value; the torque tube group (5) provides a torque value setting; accordingly, the motor (2), gear set (3), clutch set (4), torque tube group (5) and connecting shaft (6) are composed in sequence, and then a thimble (7) is used to penetrate, and the electric screwdriver is pressed up and down, so that the thimble (7) triggers up the switch, the gear set (3) is driven by the motor (2), the connecting shaft (6) is driven by the clutch set (4) to achieve the power transmission and obtain the preset torque output.

Figure 2:
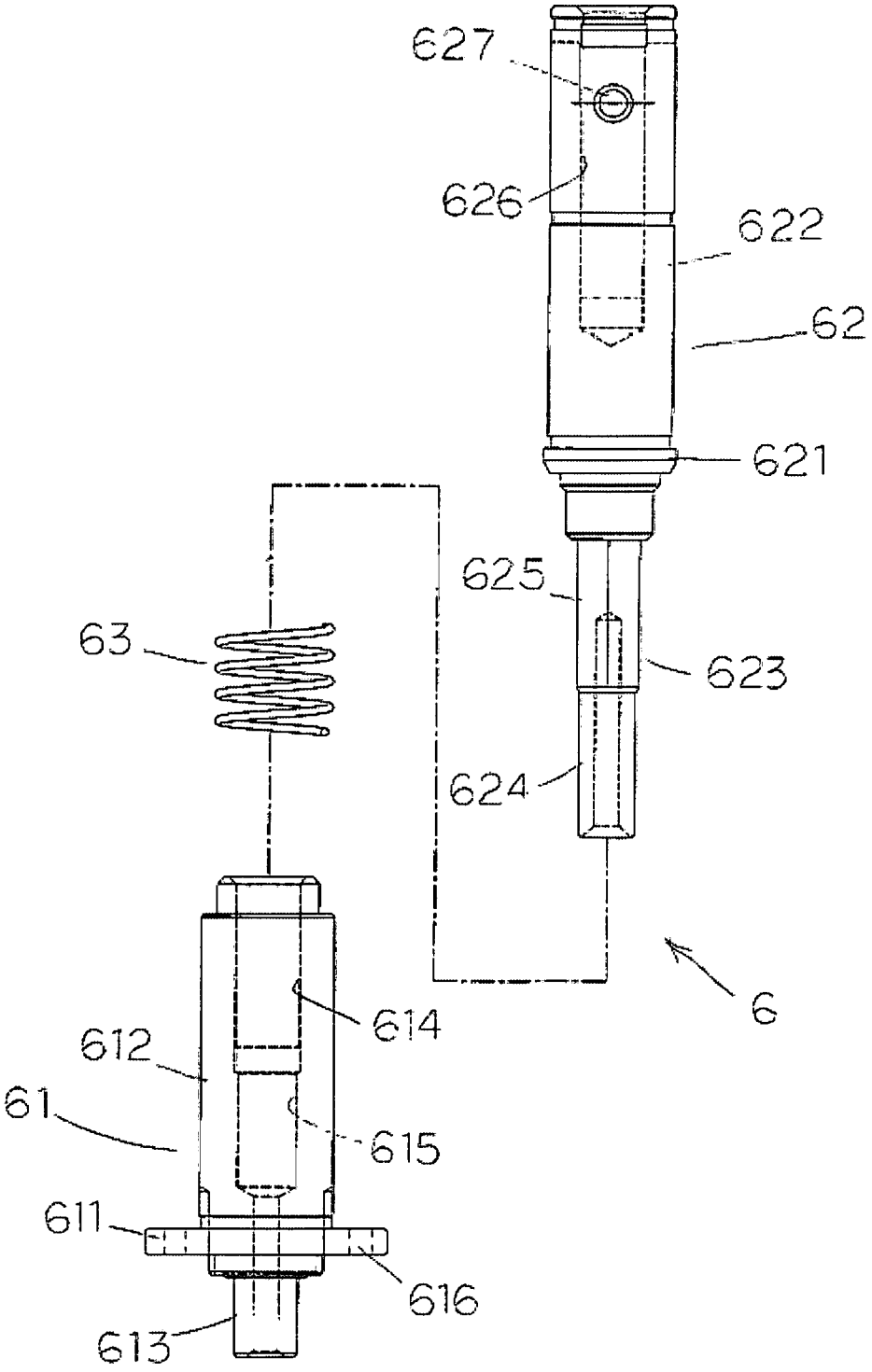
FIG. 2 is a schematic diagram for structural decomposition of the electric screwdriver connecting shaft of the present invention.

Referring to FIG. 2, the improved features of the present invention are: to improve the combined structure design of the connecting shaft (6), to improve the stability of the connection and the stability of the continuous locking, and further to prolong the service life.

Therefore, the connecting shaft (6) designed in this invention includes: a hollow upper connecting shaft (61) and a hollow lower connecting shaft (62); the upper connecting shaft (61) has a disc (611) located at the center of the non-length, and the long shaft and the short shaft with concentricity and different diameter are formed at the center of two opposite sides of the disc (611), wherein the short shaft (613) has a small diameter and combined with the clutch set (4), the long shaft (612) has a large diameter and its inside has a two-stage shaft hole connected with two different shapes; the shaft hole has a polygonal shaft hole (614) extending from the end edge of the long shaft (612) to the inside and an extending circular shaft hole (615), thereby on the one hand, providing guidance and concentricity of the combination by using the circular shaft hole (615), and on the other hand, providing the stability during combination to reduce the locking errors by using the polygonal shaft hole (614); further, the disc (612) surface is distributed with two circular holes (616) and provided with embedded steel balls, which can be connected with the clutch set (4) to each other. The lower connecting shaft (62) has a circular convex ring (621) located at the center of the length, two opposite sides of the circular convex ring (621) are respectively formed with the large shaft and small shaft (622, 623) with concentricity and different diameter; wherein, the small shaft (623) is inserted into the shaft hole of the long shaft (612) at one end of the upper connecting shaft (61), and the small shaft (623) has two-stage shaft surfaces with two different shapes, which has a cylindrical shaft surface (624) extending from the end edge to the circular convex ring (621) and an extending polygonal shaft surface (625), which coincides with the circular shaft hole (615) and the polygonal shaft hole (614). The large shaft has a shaft hole (626) and is provided with a corresponding hole (627) around and the embedded steel balls are provided therein, thereby providing a convenient combination of various screwdriver heads.

The above upper connecting shaft and the lower connecting shaft (61, 62) are matched with the polygonal shaft hole (614) and the polygonal shaft surface (625), and may be implemented in any one of a quadrangular shape, a hexagonal shape or an octagonal shape; further, the two-stage shaft hole and the two-stage shaft surface may be formed in any two shapes of the above polygonal shapes.

Figure 3:
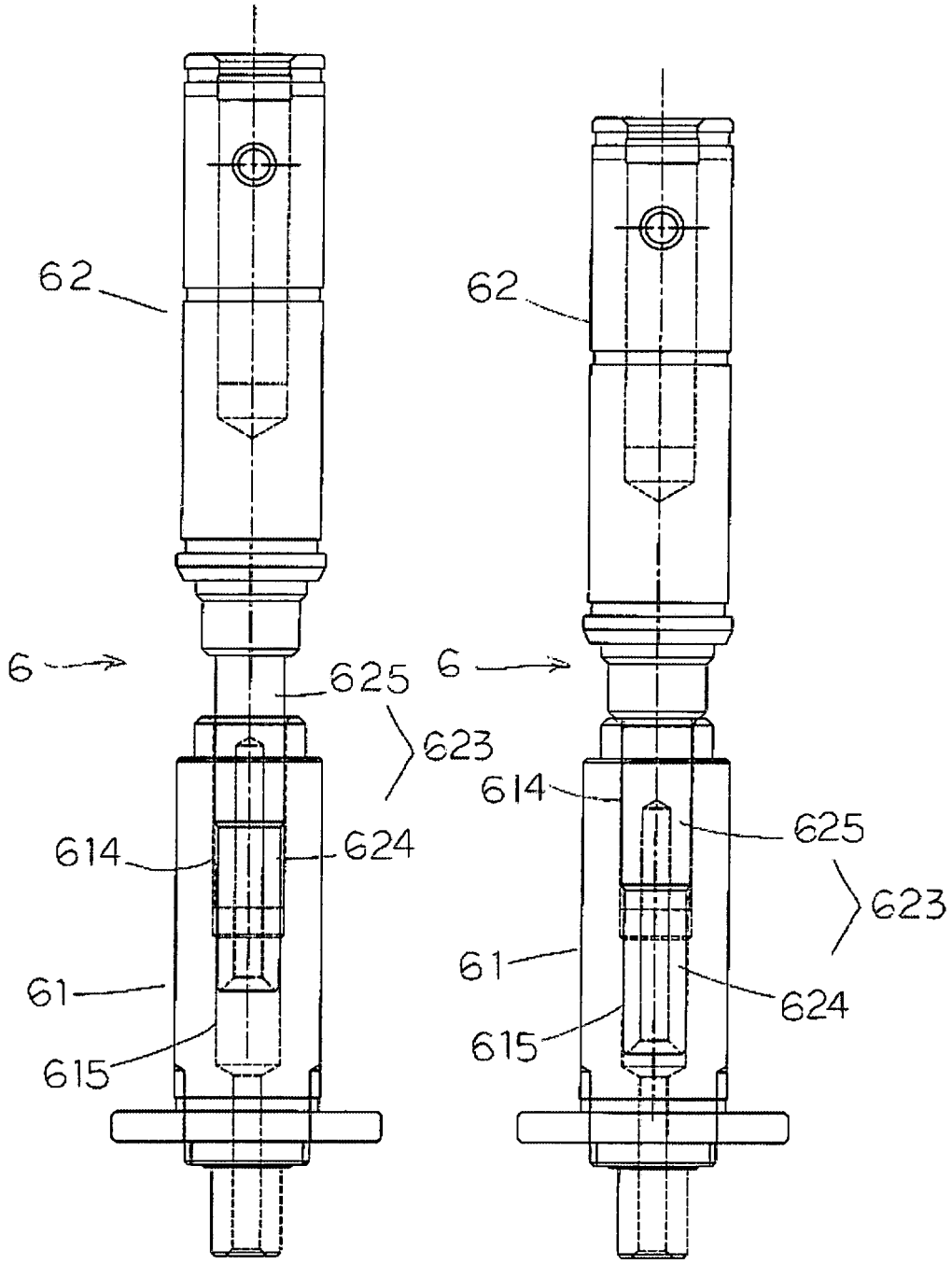
FIG. 3 is a schematic diagram for combination and action of the electric screwdriver connecting shaft of the present invention.
Figure 4:
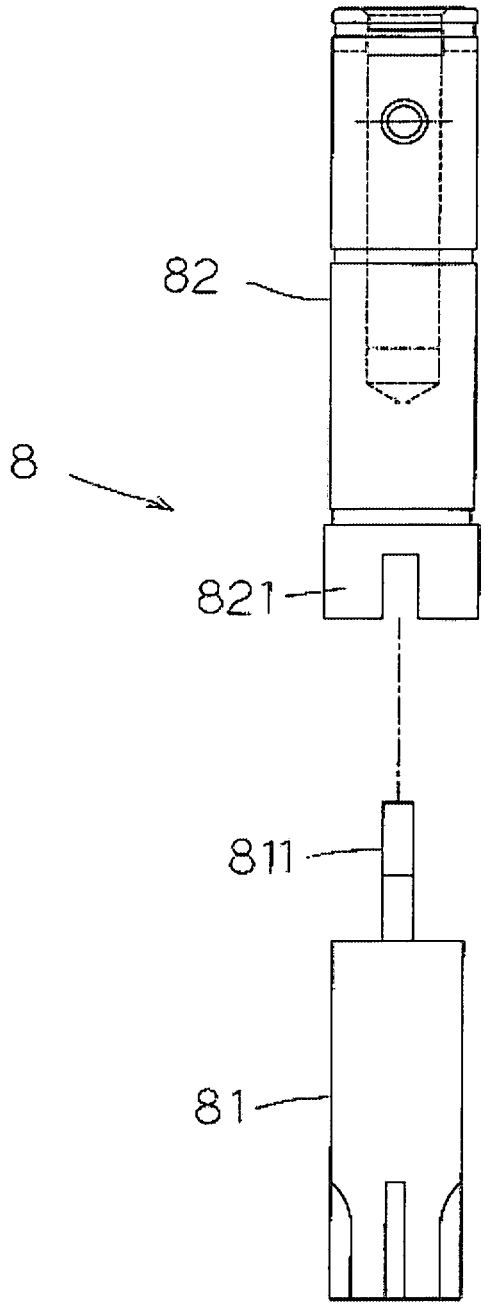
FIG. 4 is a schematic diagram for structural decomposition of the electric screwdriver connecting shaft of the present invention.

Referring to FIG. 3, according to the above connecting shaft structure, in the implementation, the upper connecting shaft and the lower connecting shaft (61, 62) are disposed between the springs (63) with press-down and restoration function. And the small shaft (623) of the lower connecting shaft (62) is inserted into the shaft hole of the upper shaft (612) at one end of the upper connecting shaft (61), which will have a cylindrical shaft surface (624) and a polygonal shaft surface (625), the two-stage shaft surface of a polygonal shaft surface (625) is inserted into a two-stage shaft hole of a circular shaft hole (615) with a polygonal shaft hole (614); when it is actuated, the lower connecting shaft (62) is extruded upwards by the press-down action of the electric screwdriver and abutted against the upper connecting shaft (61), forming a joint function to facilitate power transmission, and relaxing the electric screwdriver after the locking action is stopped, at this time, the lower connecting shaft (62) is restored by the spring (63) and leaves the upper connecting shaft (61), so that the upper connecting shaft and the lower connecting shaft (61, 62) are pressed, and closed, relaxed and moved away along the axial direction.

It can be seen from the above description that the electric screwdriver connecting shaft structure of the present invention is improved mainly by using the corresponding shaft and hole of the upper lower connecting shaft combined with the lower connecting shaft of the connecting shaft, and it is designed with the special two-stage shaft surface and two-stage shaft hole. The two-stage type is a circular shape and a hexagonal concentric design. The circular shaft surface and the shaft hole mainly provide a guiding effect and a quick combining effect when combined, the hexagonal axial surface and the shaft hole provide a stable combination effect, and the power transmission during linkage will have no depletion, and no shake affects the quality and precision of the lock, so that the electric screwdriver has better screw lock performance and precision as well as more competitiveness in the market.

The foregoing is a specific embodiment of the present invention and the technical means applied herein, and many variations and modifications can be derived therefrom based on the disclosure or teachings herein, if the equivalent changes made according to the conception of this invention have not yet exceeded the essence of the spirit covered by the instructions and schemata, they should be considered as being in the technical scope of this invention.

The invention claimed is:

1. An electric screwdriver connecting shaft structure improvement, the connecting shaft includes:

an upper connecting shaft is provided with a disc at the center of the overall non-length, and the disc is respectively provided with two shafts at the center of the two opposite sides, wherein one shaft has a two-stage shaft hole with two different shapes in the inside; and a lower connecting shaft is provided with a circular convex ring at the center of the overall length, and the circular convex ring is respectively provided with two shafts at the center of the two opposite sides, wherein one shaft has a two-stage shaft surface with two different shapes, and the two-stage shaft surface can be inserted into the two-stage shaft hole for a stable connection.

2. The electric screwdriver connecting shaft structure improvement as claimed in claim 1, wherein the two-stage shaft hole of the upper connecting shaft is formed by a polygonal shaft hole extending from the end edge of the shaft to the inside and an extending circular shaft hole.

3. The electric screwdriver connecting shaft structure improvement as claimed in claim 1, wherein the two-stage shaft hole may be composed by any two shapes of a quadrangular shape, a hexagonal shape and an octagonal shape.

4. The electric screwdriver connecting shaft structure improvement as claimed in claim 1, wherein the two-stage shaft surface of the lower connecting shaft is formed by a cylindrical shaft extending from the end edge of the shaft to the circular convex ring and an extending polygonal shaft.

5. The electric screwdriver connecting shaft structure improvement as claimed in claim 1, wherein the two-stage shaft surface may be composed by any two shapes of a quadrangular shape, a hexagonal shape and an octagonal shape.

6. The electric screwdriver connecting shaft structure improvement as claimed in claim 1, wherein the upper connecting shaft and the lower connecting shaft are sleeved with a spring.

7. The electric screwdriver connecting shaft structure improvement as claimed in claim 1, wherein the disc surface of the upper connecting shaft is distributed with two circular holes for the embedded steel balls.

8. The electric screwdriver connecting shaft structure improvement as claimed in claim 1, wherein the shaft at one side of the circular convex ring of the lower connecting shaft away from the two-stage shaft hole has a shaft hole, and a corresponding hole is provided around the hole, and the embedded steel ball is provided therein, thereby facilitating the combination of various screwdriver heads.

* * * * *